United States Patent [19]

Kwon

[11] 4,176,806

[45] Dec. 4, 1979

[54] REEL ASSEMBLY FOR CONTROLLING CORD WINDING IN KITE FLYING

[76] Inventor: Nathan J. Kwon, 1625 Greenleaf Ave., Des Plaines, Ill. 60018

[21] Appl. No.: 916,478

[22] Filed: Jun. 19, 1978

Related U.S. Application Data

[63] Continuation-in-part of Ser. No. 806,922, Jun. 15, 1977, abandoned.

[51] Int. Cl.[2] ..... B65H 75/48

[52] U.S. Cl. ..... 242/96; 244/155 A

[58] Field of Search ..... 242/96, 99, 84.8, 85.1, 242/100; 244/155 R, 155 A

[56] References Cited

U.S. PATENT DOCUMENTS

| | | | |
|---|---|---|---|
| D. 165,269 | 11/1951 | Cordell | 242/96 |
| 274,490 | 3/1883 | Gunn | 242/96 |
| 2,587,432 | 2/1952 | Bellah | 242/99 |
| 3,652,027 | 3/1972 | Wong | 242/96 |
| 4,014,477 | 3/1977 | Hyun | 242/96 |

*Primary Examiner*—Edward J. McCarthy
*Attorney, Agent, or Firm*—Patrick T. King; David L. Garrison

[57] ABSTRACT

A reel assembly for controlling line cord winding in kite flying includes an elongated main hand hold member adapted for controlling the winding of the reel assembly and a spool member adapted for receiving, storing, and releasing the cord. The spool member includes a plurality of secondary hand hold members extending axially with respect to the spool member. At least one support member extends radially from the central axis of the spool member for fixably mounting the secondary hand hold members spaced remotely from each other and from the axis of the spool member. The main hand hold member extends axially through the center of the support members and remotely from the spool member. An axle extends from the main hand hold member for supporting the spool member, which is releasably locked to the axle by a clutch mechanism.

10 Claims, 8 Drawing Figures

Fig. 5
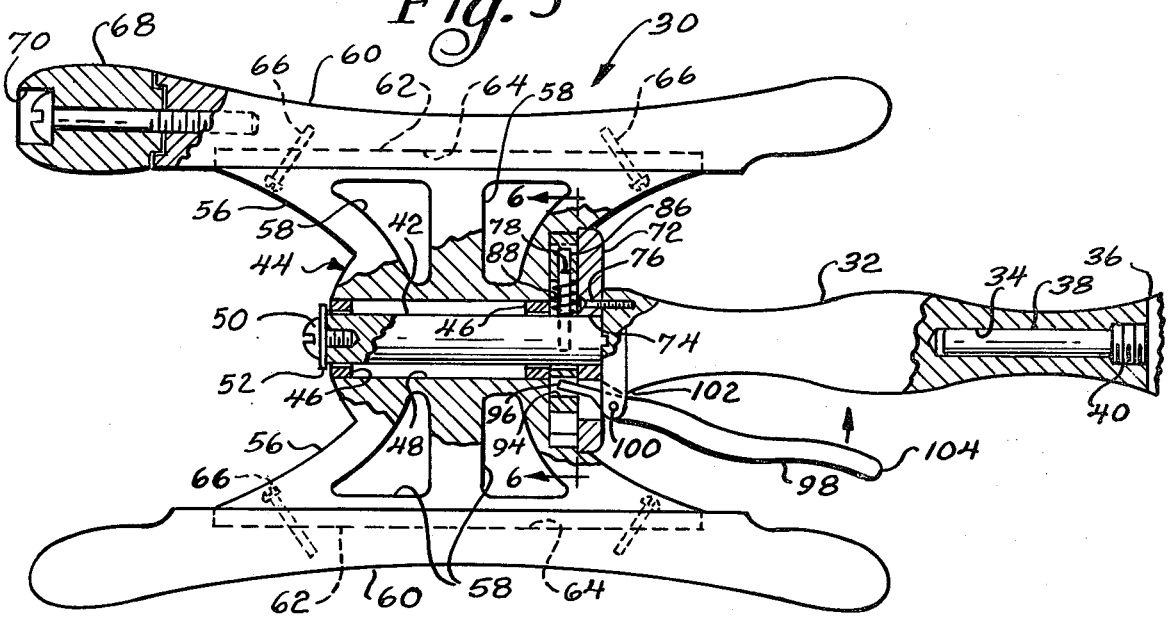
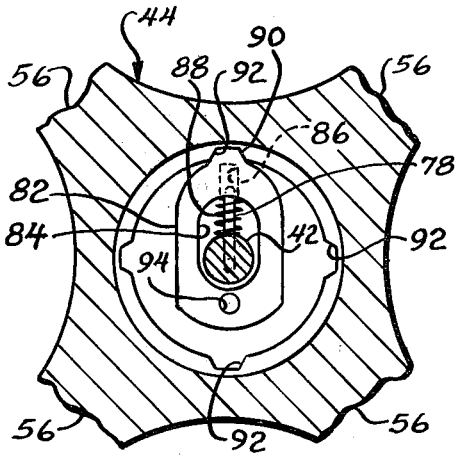
Fig. 6
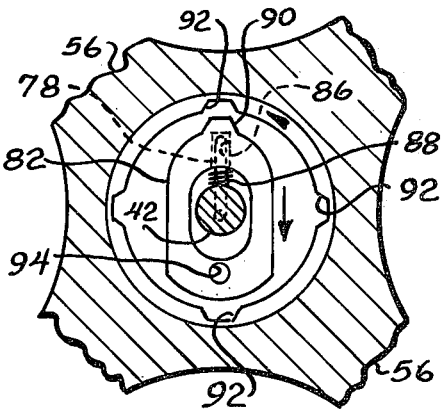
Fig. 7

REEL ASSEMBLY FOR CONTROLLING CORD WINDING IN KITE FLYING

This application is a continuation-in-part of U.S. patent application Ser. No. 806,922 filed June 15, 1977, abandoned, titled Reel Assembly For Controlling Cord Winding In Kite Flying.

BACKGROUND OF THE INVENTION

This invention relates to a reel assembly for controlling the winding of line cord in kite flying and more specifically to such an assembly whereby greater and easier control of kite flying may be readily achieved.

Kite flying has been enjoyed as a pleasurable activity for many centuries and today still remains a widely enjoyed pastime and sport. One limitation in the full enjoyment of such activity, however, is the difficulty involved in winding and unwinding the kite line cord. This problem in its simplest form involves the difficulty and tedium of winding or unwinding lengthy sections of line cord quickly and rapidly without snarling or tangling the line and possibly breaking the line. Such problem in its more complex form involves the further difficulties in controlling kite operations through proper and quick manipulation of the line cord so as to achieve the desired upward and downward movement quickly or slowly as desired. Many winding devices and reel assemblies have heretofore been suggested and utilized to overcome these problems. None, however, has yet been devised which provides a practical and simple solution to these many problems with the resulting increase in the enjoyment of kite flying.

SUMMARY OF THE INVENTION

An objective of this invention, therefore, is to provide a reel assembly for controlling line cord winding in kite flying. Another object is to provide a reel assembly which provides rapid and easy winding and unwinding of kite cord. A further object is to provide such a reel assembly which provides ready and quick control of kite cord and thereby affords positive command of a kite during flying operations. A still further object is to provide a relatively simple and umcomplicated reel assembly structure for achieving such objectives.

In practice in the invention, a reel assembly for controlling line cord winding in kite flying includes an elongated main hand hold member having an axle member coaxially extending therefrom and a spool member rotatably mounted on the axle member. A clutch mechanism for releasably fixing the spool member to the main hand hold member is also provided. A plurality of secondary hand hold members affixed to the spool member and extending axially with respect to the spool member is provided with at least one support member extending radially with respect to the central axis of the spool member for fixably mounting the secondary hand hold members spaced remotely from each other and from the central axis of the spool member. According to one aspect of the invention, the releasable clutch mechanism comprises a bolt member supported by guide means which permits movement of the bolt member perpendicularly with respect to the axle. Locking means are provided between the bolt member and the spool member along with a lever pivotally attached to the main hand hold member with one end thereof engaging the bolt member. The lever is actuable for release and engagement of the locking means. Another aspect of the invention includes having the locking means comprise a slot and tooth arrangement. The guide means includes a pin and socket for slideably receiving the pin. According to another aspect of the invention, the secondary hand hold member is concavely shaped with the midsection surface thereof depressed with respect to its terminal end so that during winding cord is directed toward the depressed midsection to provide even winding and prevent the cord from slipping over the terminal ends of the secondary hand hold members. According to another aspect of the invention at least one of the secondary hand hold members has a rotatable gripping terminal end portion. According to another aspect of the invention, the main hand hold member is generally rod shaped having a smooth circumferential surface and including a removable extending portion.

Figure 1:
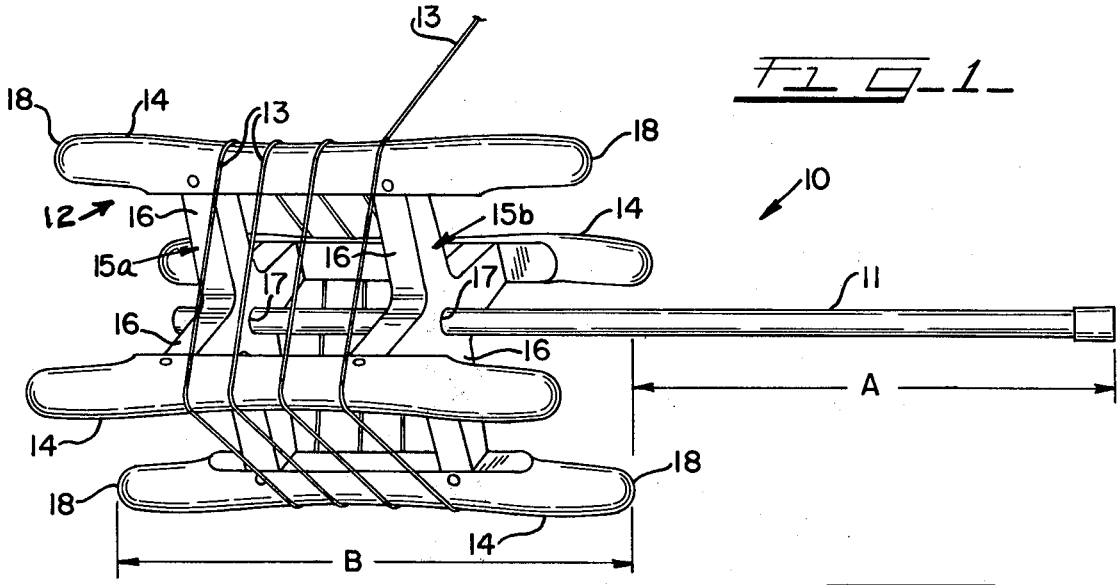
FIG. 1 is a perspective view of a first reel assembly embodiment.

FIGS. *4a* and *4b* are schematic views serving to illustrate the basic hand held operations of the reel assembly of FIG. 1.

FIG. 5 is a front elevational view of a second embodiment of a reel assembly according to the invention.

FIG. 6 is a sectional view of a portion of the second embodiment taken along section line 6—6 of FIG. 5 showing a spool in a locked position.

FIG. 7 is the same as FIG. 6 showing the spool in an unlocked position.

DETAILED DESCRIPTION OF THE PREFERRED EMBODIMENTS

In reference to FIG. 1, a first embodiment of a reel assembly 10 is illustrated as having in general combination a main hand hold member 11 and a spool member 12 of general cage-like construction and adapted for receiving, storing, and releasing kite line cord 13. Spool member 12 in such a structure includes a plurality of secondary hand hold members 14 and at least one support member 15 illustrated as two support members **15*a* and 15*b*. The secondary hand hold members 14 extend axially with respect to the central axis of the spool member 12 and are capable of releasably storing the cord 13 in winding action. The support members 15*a* and 15*b*, as illustrated in FIG. 1, are spaced from each other along the central axis of the spool member 12 and such support members 15 have spoke-shaped portions 16 which extend radially outward from a central hub portion 17, such portions 16 joining in mounted support with the secondary hand hold members 14. The support members 15 are adapted so that the main hand hold member 11 passes through, in fixed arrangement, the center of hub portion 17**.

In simple structure, the reel assembly 10 of this invention, as illustrated in FIG. 1, may be fabricated of any suitable construction material such as plastic or preferably wood to provide the desired lightweight and structural strength. Generally in construction and operation any number of secondary hand hold members 14 may be employed but in order that there be appropriate winding action preferably at least three secondary hand hold members 14 are employed for winding the cord 13 in a cage-like fashion about the spool member 12.

Generally, as shown in FIG. 1, four secondary hand hold members 14 are employed in the first embodiment and these four members 14 form a generally rectangular configuration in a traverse cross section of the spool member 12 (not shown). Use of a different number of secondary hand hold members will achieve a different type of cross-sectional configurational appearance. For example, while not shown, five secondary hand hold members will generally form a pentagon configuration while six members will form a hexagon configuration.

A different number of secondary hand hold members 14 will, of course, require a different number of spoke-shaped portions 16 of the support member 15 for joining and supporting the secondary hand hold members 14.

Figure 2:
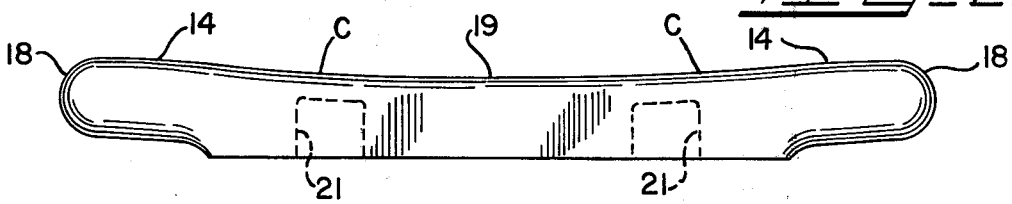
FIG. 2 is a front elevational view of a secondary hand hold member shown detached from the reel assembly of FIG. 1.

The secondary hand hold members 14 in the first embodiment have terminal end sections 18 which are appropriately shaped in bulb or tubular fashion for easy hand gripping. As best illustrated in FIG. 2, the hand hold members 14 are concavely shaped in their longitudinal direction so that during turning of the spool member 12 the cord 13 is generally forced centrally inwardly by the downward slope C of the secondary hand hold member 14 into the central, midsection 19. This provides for more uniform winding and prevents the cord 13 from sliding over the terminal ends 18 of the secondary hand hold member 14 and consequently becoming snarled and/or knotted. In a typical structure, the concave sloping of the secondary hand hold member 14 is such that the depressed midsection 19 of such hand hold member is at least about 3/16 of an inch lower than the upper surface of the terminal ends 18.

Figure 3:
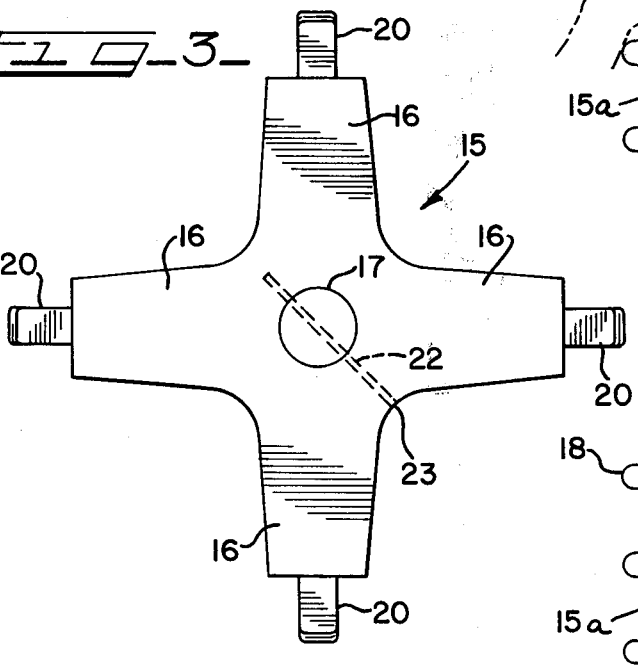
FIG. 3 is a front elevational view of a support member shown detached from the reel assembly of FIG. 1.

The support member 15 principally serves to achieve the structural support for the secondary hand hold members 14 and to space such hand hold members 14 radially remotely from the central axis of the spool member 12 to thus form the cage-like structure for such spool member 12. In simplest arrangement, any number of support members 15 may be utilized and of various structural configurations. Preferably, however, at least two members 15 are utilized and such members are typically spaced remotely from one another along the central axis of the spool member 12. While the structural configuration for the support members 15 may be varied, a preferred arrangement, and as best illustrated in FIG. 3, comprises a support member having a plurality of spoke-shaped portions 16 which extend radially outward from a central hub portion 17. The spoke-like projections 16 may be joined to the secondary hand hold members 14 by any appropriate fastening mechanisms, for example, use of dowel pin extensions 20 which pressure fit into mating grooves 21 of the secondary hand hold member 14 (FIG. 2). The central hub portion 17 of the support member 15 is adapted to receive in fixed arrangement the main hand hold member 11, for example, through hole 22 positioned in the center of the hub section 17. Such joining of the main hand hold member 11 and support member 15 through hole 22 may be achieved through a simple pressure fitting or more positively by means of a pin 23. Such joining assures a locking arrangement whereby any turning or rotation of the main hand hold member 11 will also rotate or turn the support member 15 and consequently the entire spool member 12 in winding fashion.

The main hand hold member 11 is suitably of rod-like shape with a smooth outer perimeter surface so that the rod-like member 11 may readily and freely turn with low friction when lightly hand held. Main hand hold member 11, as illustrated in FIG. 1, extends longitudinally, that is axially along the central axis of the spool member 12 and through the center of the support members 15*a* and 15*b* and continues beyond the terminus of the spool member 12 as generally delineated by the terminal end 18 of the secondary hand hold member 14. In order that there be proper balance and control of the reel assembly 10, and as more fully discussed hereinafter, it is generally desirable that the longitudinal or axial length of main hand hold member 11 extending beyond the spool member be at least a length equal to the longitudinal, axial length B of the spool member 12 as delineated by the length of the secondary hand member 14 and more preferably at least 1½ times such length, that is where the length A of FIG. 1 is at least 1½ times the length B.

Generally the dimensions of the reel assembly 10 may be varied depending upon the desired type of kite flying intended. In typical operation, a reel assembly 10, having the preferred four secondary hand hold members 14, the hand hold members 14 are usually about 8.5 inches in longitudinal, axial length, the main hand hold member 11 is about 17.5 inches in overall axial length with about 11 inches of such length extending beyond the end terminals 18 of the secondary hand hold member 14 which corresponds to length A of FIG. 1. The spoke-shaped portions 16 of the support members 15 typically have a radial length of about 5 inches with the rod-shaped main hand hold member 11 having a diameter of about 0.5 inches.

Figure 4A:
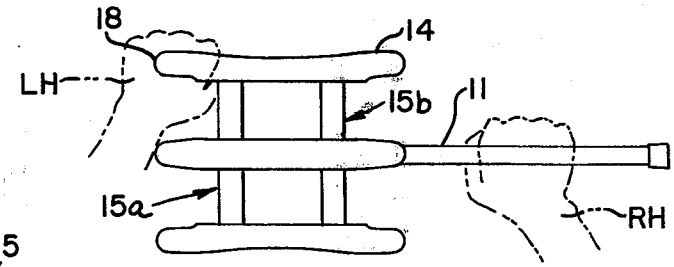
Figure 4B:
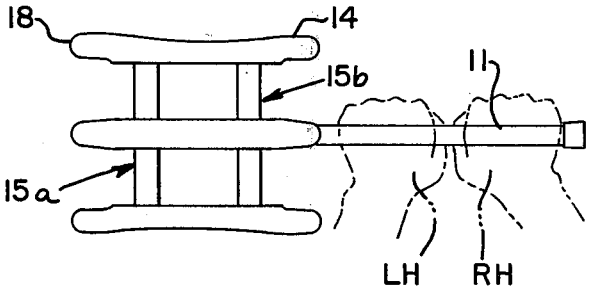

Operation of the reel assembly 10 of this invention is best illustrated by reference to FIGS. 4*a* and 4*b* which are simplified schematic illustrations of assembly 10 as held by the right and left hands of the kite operator. For purposes of simplicity, only portions of the assembly 10 are shown. Also, operation is shown only for right hand operation. Left hand operation would only involve simply reversing the assembly so that the main hand hold member 11 extends to the left rather than to the right as shown.

In winding operations the left hand is positioned on the terminus 18 of the secondary hand hold member 14 and the right hand is positioned on the main hand hold member 11. In slow wind operation the left hand is rotated and the spool member 10 turned to wind the cord 13 while the main hand hold member 11 rotates freely while being loosely held by the right hand. In fast wind or retrieve of the cord the length of the main hand hold member 11 permits the entire reel assembly 10 to be spun by holding the left hand relatively stable while gripping the terminus 18 of the secondary hand hold member 14 and by inducing a spinning action to the entire reel assembly through movement of the right hand holding the main hand hold member 11. Such spinning action of the entire reel assembly 10 allows for a very quick and fast rewind of the cord. Unwinding operation of the reel assembly 10 is best represented by reference to FIG. 4*b*. Both the left and right hands are positioned on the rather lengthy extension of the main hand hold member 11 where a loose holding of such member 11 permits the spool member 12 or the entire reel assembly 10 to turn rapidly and release the cord as pulled by an upward or outward moving kite. Proper positioning of the right and left hands on the lengthy main hand hold member 11 permits the reel assembly to be stabilized and to turn without any wobbling or irregularity which would adversely affect the kite movement. The rate of cord release is also readily and simply controlled by simply adjusting hand pressure on the main hand hold member 11 by the right and left hands.

Referring now to FIG. 5 of the drawings, a second embodiment of a reel assembly 30 is shown. A main hand hold member 32, similar to the member 11, is provided with a contoured cylindrical surface to facilitate operation and handling. An axial bore 34 is formed in one end of the hand hold member 32. An extension member 36 (partially shown) of generally cylindrical cross-sectional area coaxially extends from the main hand hold member 32 and is fastened thereto by a cylindrical rod portion 38 which seats within the axial bore 34 and is held therein by threads 40 which cooperate with threads formed within the axial bore 34. The length of the extension member 36 is approximately the same as that of the main hand hold member 32 and permits the reel assembly 30 to be reduced in overall length for ease of shipping and assembly. The surface of the extension member 36 is also contoured to facilitate ease of operation. Affixed to and coaxially extending from the main hand hold member 32 is an axle 42 which supports and about which pivots a spool member 44. The spool member 44 is rotatably supported on the axle 42 by bearings 46 which are, for example, pressfit respectively into the ends of a central bore 48 formed through the spool member 44. A screw 50 threaded through a retaining washer 52 into a threaded aperture in the end of the axle 42 opposite the handle 32 retains the spool member 44 on the axle 42. The spool member 44 has four web-like support members radially extending therefrom each of which has three spoke-like members 56 with apertures 58 formed therebetween. Secondary hand hold members 60 are fastened to the support members of the spool member 44 by having projecting portions 62 at the ends thereof engage corresponding slots 64 in the secondary hand hold members 60 with screws 66 providing secure fastening therebetween. The secondary hand hold members 60 are generally elongated pieces having depressions formed in the center portions thereof for forcing a cord (not shown) toward the central part of the member providing for more uniform winding and prevention of the cord from sliding over the ends of the members, similar to the function performed by the first embodiment of this invention as hereinabove described. At the ends of two of the secondary hand hold members 60 removed from the main hand hold member 32 are positioned rotatable knobs 68 (one shown), each rotatable about a bolt passing through the axis of each of the rotatable knobs 68, the head of each bolt being positioned within a counter bore 70 within each knob and the bolt threads engaging threads formed within a bore 70 in the ends of the secondary hand hold member 60. In operation, a user grasps the knob 68 with one hand while the other hand grasps the main hand hold member 32. The reel assembly 30 is operated similarly to the reel assembly of the first embodiment of this invention as hereinabove described.

The second embodiment of the reel assembly 30 has a feature which permits the spool member 44 to rotate freely with respect to the main hand hold member 32. A circular plate-like member 72 having a central aperture 74 formed therein for receiving the axle 42 therethrough is affixed to the end of the main hand hold member 32 by a plurality of screws (typically shown at 76) which are threaded into the main hand hold member 32. Referring to FIG. 6 of the drawings, a portion of the spool member 44 showing four spoke-like members 56 is shown in a sectional view. Referring also to FIG. 7 of the drawings, the axle 42 has a pin 78 affixed to and extending from a radial bore formed within the axle 42. A movable clutch bolt member 82 has an elongated central slot 84 formed therein, the width of the slot being slightly larger than the diameter of the axle 42. A bore 86 is formed in the clutch bolt member 82 at one end of the elongated central slot 84 for receiving the pin 78. A biasing spring 88 tends to push the clutch bolt member 82 such that a tooth 90 formed on an exterior end of the clutch bolt member 82 falls into one of a plurality of slots 92 radially extending from a large bore in the end of the spool member 44 when the spool member is rotated to align the tooth 90 with one of the slots 92, as shown in FIG. 6 of the drawing. An aperture 94 formed through the clutch bolt member 82 receives one end of a clutch lever 98 which extends through a bore in plate 72 and which is pivotally mounted on a pin 100 extending through a projecting portion 102 of the main hand hold member 32. When the other end 104 of the clutch lever 98 is pushed in the direction of the arrow as shown toward the main hand hold member 32, the clutch bolt member 82 is moved against the biasing force of the spring 88 and the tooth 90 is disengaged from one of the slots 92 on the spool member 44 as shown in FIG. 7 of the drawing. The end 104 of the clutch lever 98 is actuated as required by the hand or fingers of an operator. In operation, an operator by actuating the clutch lever 98 causes the spool member 44 to freely rotate about the axle 42. When the other end 104 of the clutch lever 98 is not engaged by an operator, the spool member 44 is fixedly locked to the axle 42 and no rotation is allowed therebetween. The handle 32 and the spool 44, in this case, function as in the first embodiment of this invention.

While particular embodiments of the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

What is claimed is:

1. A reel assembly for controlling line cord winding in kite flying comprising:

an elongated main hand hold member adapted for controlling the winding of the reel assembly;

an axle member affixed to and coaxially extending from the main hand hold member;

a spool member having a central axis and adapted for receiving, storing, and releasing the cord, the spool member rotatably mounted on the axle member;

a clutch mechanism for releasably fixing the spool member to the main hand hold member;

a plurality of secondary hand hold members affixed to the spool member and extending axially with respect to the spool member and capable of releasably storing the cord; and at least one support member extending radially with respect to the central axis of the spool member for fixably mounting the secondary hand hold members spaced remotely from each other and from the central axis of the spool member.

2. The reel assembly of claim 1 wherein the releasable clutch mechanism comprises:

a bolt member;

guide means for supporting the bolt member and for permitting movement of the bolt member perpendicularly with respect to the axle member;

locking means between the bolt member and the spool member for releasably fixing the bolt member to the spool member; and a lever pivotally attached to the main hand hold member, one end of the lever engaging the bolt member for movement thereof, the lever being actuable for release and engagement of the locking means.

3. The reel assembly of claim 2 wherein the locking means comprise a slot and tooth arrangement for releasably fixing the bolt member to the spool member.

4. The reel assembly of claim 2 wherein the guide means includes a pin and a socket for slideably receiving said pin.

5. The reel assembly of claim 2 including biasing means for urging the locking means into engagement.

6. The reel assembly of claim 2 wherein the bolt member includes a plate-like member having a central elongated slot therein with the axle passing therethrough.

7. The reel assembly of claim 1 wherein each secondary hand hold member is concavely shaped whereby the midsection surface of such member is depressed with respect to its terminal ends so that during winding the cord is directed towards such depressed midsection to provide even winding and prevention of the cord from slipping over the terminal ends of the secondary hand hold member.

8. The reel assembly of claim 1 wherein at least one of the secondary hand hold members has a rotatable gripping terminal end portion generally coaxial with the secondary hand hold member to facilitate rotation of the spool member.

9. The reel assembly of claim 1 wherein the main hand hold member is generally rod shaped having a smooth circumferential surface for turning readily when loosely hand held and wherein such hand hold member extends remotely beyond the spool member.

10. The reel assembly of claim 9 wherein the main hand hold member includes a removable extending portion, permitting disassembly of the hand hold member.

* * * * *